United States Patent [19]

Mills

[11] Patent Number: 4,891,881

[45] Date of Patent: Jan. 9, 1990

[54] COMBINED CUTTING TOOL AND SHARPENER

[76] Inventor: Norman T. Mills, 61 Harrison Ave., Glens Falls, N.Y. 12801

[21] Appl. No.: 352,401

[22] Filed: May 16, 1989

Related U.S. Application Data

[63] Continuation-in-part of Ser. No. 180,821, Apr. 12, 1988.

[51] Int. Cl.[4] ..... D25F 3/00

[52] U.S. Cl. ..... 30/123; 7/160

[58] Field of Search ..... 30/123, 451, 434, 457, 30/162, 125, 335; 7/118–120, 160

[56] References Cited

U.S. PATENT DOCUMENTS

| | | | |
|---|---|---|---|
| 497,897 | 5/1893 | Schickler | 30/123 |
| 665,759 | 1/1901 | Schretter | 7/160 |
| 2,256,707 | 9/1941 | Fultz | 7/160 X |
| 4,783,867 | 11/1988 | Tsao | 30/123 X |

*Primary Examiner*—Douglas D. Watts

*Attorney, Agent, or Firm*—Richard C. Litman

[57] ABSTRACT

A tool includes a handle having a cutting blade, a writing implement sharpener and spare blade compartment combined in the one tool. One embodiment permits the blade to have an adjustable disposition while another embodiment fixes the disposition of the blade. In one embodiment the sharpener is located at one of the ends of the tool handle while in the other embodiment the sharpener is located at a mid portion of the handle. In the case where the disposition of the blade is adjustable, a leaf spring biases a lug into an indentation and another lug detent into a recess in the blade. The leaf spring slides above the blade between two separable longitudinal halves of the handle. The sharpener assembly is fixedly retained within the confines of the tool body with an aperture in abutting rims of two shells of the body providing for insertion of the implement to be sharpened. Shavings are discharged exteriorly of the tool through a slot formed in one of the body shells adjacent the blade of the sharpener.

5 Claims, 2 Drawing Sheets

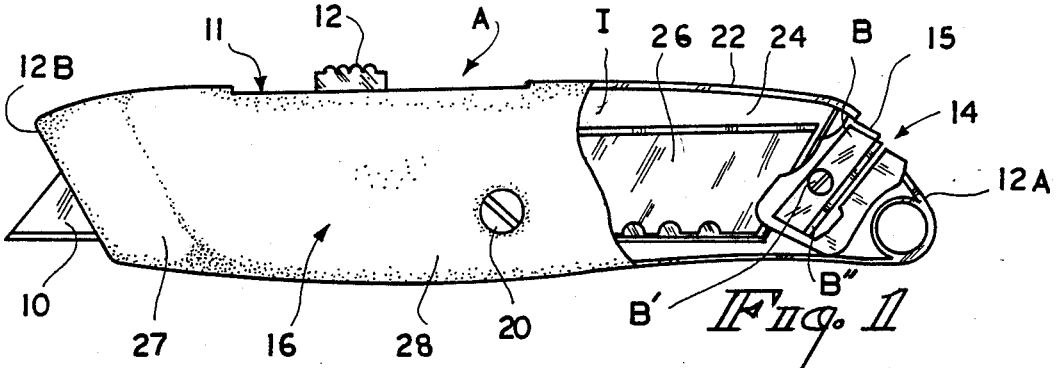
FIG. 1
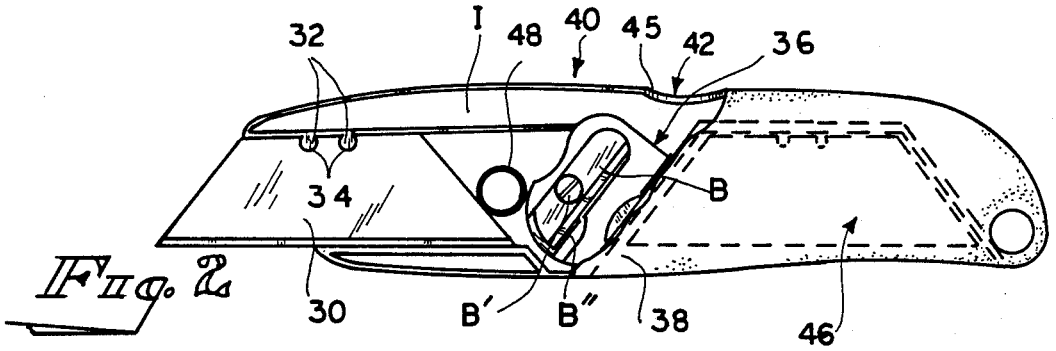
FIG. 2
FIG. 3
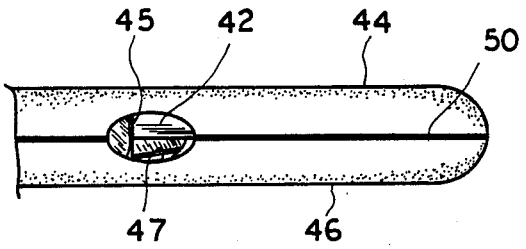
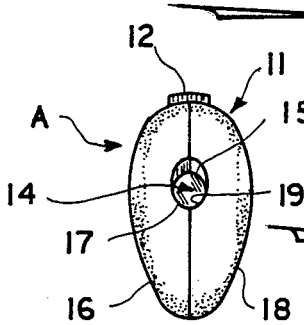
FIG. 4
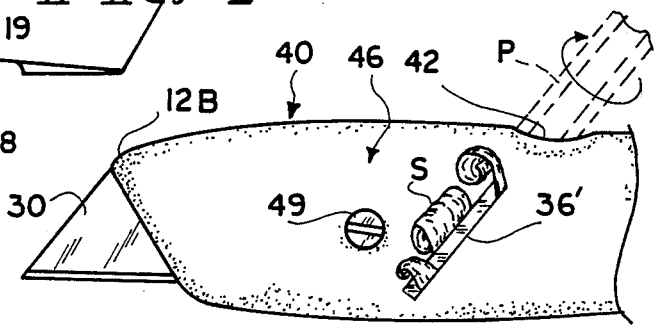
FIG. 5
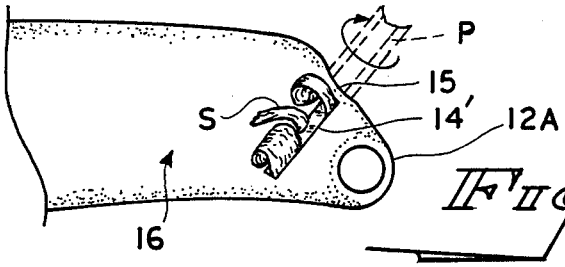
FIG. 6

COMBINED CUTTING TOOL AND SHARPENER

CROSS REFERENCE TO RELATED APPLICATION

This is a continuation-in-part of my prior application Ser. No. 180,821 filed on Apr. 12, 1988.

BACKGROUND OF THE INVENTION

In the construction trade, workmen, particularly carpenters, must frequently provide scribed markings or lines upon workpieces preparatory to cutting or aligning with other structural components. These guide lines are produced by a pencil or the like, preferably comprising a consumable soft material, such as wax or lead and require that the user periodically trim or sharpen the implement with a separate, disparate instrument. A pocket knife is the most common device employed to accomplish this chore and this results in the user frequently their pockets or tool box for the knife.

It would be advisable for the workmen performing the cutting operation to have a writing implement sharpener readily available to him in concert with a common tool for scribing sheet panels. This is particularly of interest since, many marking operations encountered by carpenters involve the scribing of composition panels by means of a utility knife. Such need is conveniently met by the tool of this invention which combines in one tool a utility knife having a cutting blade; which may be retractable; a sharpener within the confines of the tool body; and a compartment for spare blades. This is a boon to cutting operations on work scenes where the workman may be moving about from one area to another without having to carry a separate sharpener about. With this invention the workman will always have available a scribing knife when called for, as well as means for maintaining a sharpened pencil, as required for those other types of marking, without the need to reach for a separate sharpening apparatus, or to open up or otherwise reconfigure a multipurpose cutting device.

DESCRIPTION OF RELATED ART

U.S. utility patent number 653,807 to A. Hofstetter is drawn to a writing implement and penknife combination.

U.S. utility patent number 665,759 to V. J. Schretter is drawn to a sharpener, penknife combination.

U.S. utility patent number 2,814,864 to E. A. Zevely et. al., is drawn to a carton opener and adjustable cutting tool.

U.S. utility patent number 3,063,147 to J. Paparelli is drawn to an adjustable cutting tool with a sliding leaf spring, and cammed blade to change the orientation of the blade with respect to the handle of this invention.

U.S. utility patent number 3,518,758 to R. A. Bennett is drawn to a utility knife with an adjustable and rotatable blade.

U.S. utility patent number 3,846,909, to R. E. Clarke is drawn to a knife blade with a handle that can sharpen the knife blade.

U.S. utility patent number 4,117,748 to K. E. Watts is drawn to a scabbard that can sharpen knife blades.

SUMMARY OF THE INVENTION

It is an object of the present invention to provide an improved composite tool including a knife blade at one end that may be retractable and which is provided with a pencil sharpener with the body of the tool.

Another object of the present invention is to provide a convenient pencil sharpener fixedly contained within the interior of a utility knife body.

A further object of the present invention is to provide an improved combination tool including a rigid body shell containing a blade storage compartment, knife blade at one end and a pencil sharpener which may be fixedly contained adjacent the other end of the tool body or alternatively, within its medial portion.

It is an object in one embodiment to make the blade adjustably retractable.

It is a further object to provide another embodiment with a fixed blade.

Still another object of the present invention is to provide an improved composite tool having a cutting blade projecting from one end of the tool body with a pencil sharpener fixedly mounted within the confines of two shells of the tool body and access to the sharpener being had through an opening defined by two semi-circular cutouts in abutting rims of the body shells.

Another object of the present invention is to provide an improved combination tool including an elongated body having a knife blade at one end and containing a pencil sharpener fixed within the body with a shavings discharge port in the tool body.

BRIEF DESCRIPTION OF THE DRAWING FIGURES

FIG. 1 is a side elevation, partly broken away, of one embodiment of the composite tool of the invention;

FIG. 2 is a view similar to FIG. 1 and illustrates an alternate embodiment;

FIG. 3 is a fragmentary top plan view of the device shown in FIG. 2;

FIG. 4 is a right end elevation of the device shown in FIG. 1;

FIG. 5 is a partial side elevation of the tool of FIG. 2 illustrating a pencil being sharpened therewith;

FIG. 6 is a partial side elevation of the tool of FIG. 1 showing a pencil being sharpened.

DESCRIPTION OF THE PREFERRED EMBODIMENTS

Figure 7:
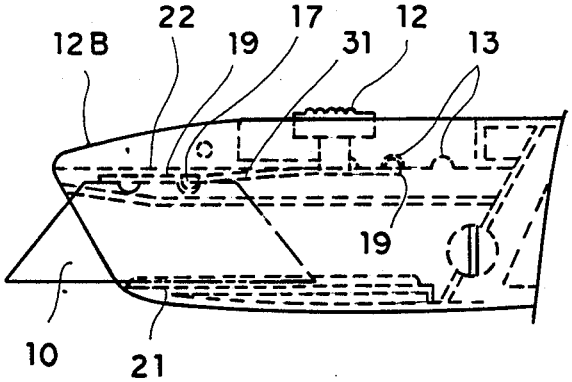
FIG. 7 is a fragmentary view of the tool of FIG. 1 depicting the mechanism by which the cutting blade exposure is made adjustable through a sliding leaf spring and lug-indentation mechanism.

In FIG. 1 is shown one embodiment A of the combined knife and pencil sharpener. This combination includes a rectractable blade 10 whose position, outside or inside the elongated handle body 11, is determined by a longitudinally displaceable, finger engageable slide 12. A pencil sharpener assembly 14 is mounted adjacent the trailing end 12A of the handle body opposite that of the blade 10 as projecting from the leading end 12B.

As shown most clearly in FIG. 4, the handle body 11 is divided in two mating halves or shells 16 and 18. A screw 20 fastens the two halves 16 and 18 together and interlocking structure along the abutting peripheral rims 22 of the two halves 16 and 18 maintain the two halves in place when locked upon tightening of the screw 20. An internal compartment 24 is provided within the halves for holding spare blades 26. The compartment 24 is located in the rear portion 28 of the handle body on a side of the screw 20 opposite that forward portion 27 within which the ready to use blade 10 is housed. An aperture 15 is formed adjacent the handle trailing end portion 12A as shown in FIGS. 1, 4 and 6 for a writing implement to be inserted for sharpening by the replaceable blade B of the sharpener assembly 14. Aperture 15 is formed by complementary indentations 17 and 19 in the juxtaposed rims 22 of the two shells 16,18 and will be seen to comprise substantially semi-circular cutouts therein, sized to closely accommodate the body of a pencil.

The sharpener assembly 14 will be seen to include a fastener B' adapted to removably secure the blade B in a fixed manner within the confines of the tool handle body 11 so that at all times the sharpener assembly is ready for use upon the insertion of a pencil P through the body opening 15. Upon subsequent rotation of the inserted pencil, with its tip fully disposed within the tool interior I and adjacent the blade edge B", the tip is sharpened, with the resultant shavings S being discharged, exteriorly of the tool, through the longitudinal slot or opening 14'.

FIG. 2 shows a second embodiment wherein the cutting blade 30 is held stationary in the handle 13 by means of lugs 32, 32 therein. The blade 30 includes circular indents 34, 34 to accommodate the circular lugs 32. In this embodiment of FIG. 2 there the pencil sharpener assembly 36, containing the same components as the previously described sharpener 14, is fixedly mounted in the mid portion 38 of the handle body 40, as formed by the body shells 44,46. An aperture 42 as shown in FIGS. 2, 3 and 5 admits insertion of the writing implement into the sharpener 36 at this mid portion 38 of the handle. FIG. 3 shows the handle divided into two longitudinal shells or halves 44 and 46 having mating rims 50. These halves are fastened together by a screw 49 in a hole 48. Aperture 42 is formed by complementary indentations or substantially semi-circular cutouts 45 and 47 in the rims 50 of the halves 44 and 46 in the mid portion 38 of the handle.

As in the first described embodiment, a discharge slot or opening 36', adjacent the sharpener blade edge B" allows for the generated shavings S to be discharged exteriorly of the tool handle body.

FIG. 7 shows the embodiment of FIG. 1 wherein the slide mechanism 12 is shown in phantom lines. As can be seen there is a resilient detent at 17 to hold the blade toward an inner portion 19 of the slide 12. There are three indentations at 13 for a like number of adjustments of the amount of exposure of the blade 10. Leaf spring 31 provides a biasing force to urge the slide 12 into indentations 13 at detent 19. Lower sheath member 21 and upper sheath member 22 in both halves 16 and 18 limit motion of the blade 10 to an in and out motion relative the sheath members.

With either embodiments it will be appreciated that the size capacity of the sharpener assembly 14 or 36 as well as the aperture 15 or 42 may be changed in order to accommodate writing implements of alternate sizes. Although these parameters may be altered, it will be understood that when any one configuration is defined, the selected sharpener assembly remains in a fixed or stationary disposition as the tool is utilized, either its blade 10,30 or the sharpener blade B.

What is claimed is:

1. A combined tool comprising an elongated handle having opposite leading and trailing end portions, said handle comprising two shell halves having mating peripheral rims and defining a hollow interior, releasable fastener means retaining said shell halves together with said rims in fixed abutment, a cutting blade having a portion projecting from said handle leading end portion, lug means within said handle adjacent said leading end portion engaging and retaining said blade in a disposition ready for cutting, a compartment within said handle hollow interior adapted to contain spare cutting blades, a stationary pencil sharpener assembly disposed fully within said handle hollow interior angularly offset relative the longitudinal axis of said elongated handle, said pencil sharpener assembly including a blade fixedly mounted within said handle hollow interior, said handle provided with an aperture adjacent said pencil sharpener assembly and defined by two complementary juxtaposed indentations in said shell half rims intermediate said handle end portions, said aperture adapted to receive a pencil to engage said pencil sharpener fully disposed within said handle hollow interior, and a discharge slot formed in one said shell half permitting the dispensing of shavings as a pencil is sharpened by use of said sharpener within said handle interior.

2. A tool according to claim 1 including, slide means manipulatable exteriorly of said handle to axially displace said lug means for adjustably extending said cutting blade from said leading end portion.

3. A tool according to claim 1 wherein, said pencil sharpener assembly is disposed substantially mid way between said two end portions of said handle intermediate said cutting blade and spare blade compartment.

4. A tool according to claim 1 wherein, said pencil sharpener assembly is disposed adjacent said trailing end portion of said handle body.

5. A tool according to claim 1 including, a removable fastener engaging said pencil sharpener blade and providing said fixed mounting of said pencil sharpener.

* * * * *